US010711449B2

(12) United States Patent
Bhate

(10) Patent No.: US 10,711,449 B2
(45) Date of Patent: Jul. 14, 2020

(54) SYSTEM FOR WALL TO WALL CONNECTION FOR PRECAST SHEAR WALLS AND METHOD THEREOF

(71) Applicant: PRECASE INDIA INFRASTRUCTURES PVT. LTD., Pune (IN)

(72) Inventor: Ajit Bhate, Pune (IN)

( * ) Notice: Subject to any disclaimer, the term of this patent is extended or adjusted under 35 U.S.C. 154(b) by 0 days.

(21) Appl. No.: 16/097,153

(22) PCT Filed: Apr. 26, 2017

(86) PCT No.: PCT/IN2017/050146

§ 371 (c)(1),
(2) Date: Oct. 26, 2018

(87) PCT Pub. No.: WO2017/187451

PCT Pub. Date: Nov. 2, 2017

(65) Prior Publication Data

US 2019/0127965 A1 May 2, 2019

(30) Foreign Application Priority Data

Apr. 28, 2016 (IN) ..... 201621014761

(51) Int. Cl.
*E04B 1/02* (2006.01)
*E04B 1/04* (2006.01)
(Continued)

(52) U.S. Cl.
CPC ..... *E04B 1/043* (2013.01); *E04B 1/383* (2013.01); *E04G 21/125* (2013.01); *E04B 2/60* (2013.01)

(58) Field of Classification Search
CPC ..... E04G 21/125; E04B 1/043; E04B 1/21; E04B 1/4121; E04B 1/41; E04B 1/383
See application file for complete search history.

(56) References Cited

U.S. PATENT DOCUMENTS 4,718,209 A * 1/1988 Hansen ..... E04C 5/122 52/223.13
5,044,136 A 9/1991 Liu
(Continued)

FOREIGN PATENT DOCUMENTS

WO 2015/168742 * 11/2015
WO 2015/168742 A1 11/2015

OTHER PUBLICATIONS

International Search Report and Written Opinion dated Aug. 22, 2017, in International Application No. PCT/IN2017/050146, filed Apr. 26, 2017.

*Primary Examiner* — Gisele D Ford
(74) *Attorney, Agent, or Firm* — Wiley

(57) ABSTRACT

A system for wall to wall connection for precast shear walls includes a plurality of horizontal and vertical reinforcement bars configured within the precast shear wall. The system also includes a plurality of connecting tubes fixed between the spacing provided between the reinforcement bars, a plurality of openings provided between the plurality of connecting tubes, a plurality of grout tubes fixed above the plurality of openings to grout the openings after completing confection of the shear walls, a plurality of connecting bars capable of being inserted within the connecting tubes of the precast shear wall, when erected, a connecting device for inserting through the openings to grip the connecting bars, and a driving device to supply power to the drive for causing rotation of the drive/manual action and, thereby, sending the connecting bar in a translational motion from the first shear wall to the second shear wall.

6 Claims, 8 Drawing Sheets

(51) Int. Cl.

| | |
|---|---|
| ***E04B 1/38*** | (2006.01) |
| ***E04G 21/12*** | (2006.01) |
| *E04B 2/60* | (2006.01) |

(56) References Cited

U.S. PATENT DOCUMENTS

| | | | | |
|---|---|---|---|---|
| 5,134,828 | A | 8/1992 | Baur | |
| 5,537,794 | A * | 7/1996 | Tolliver | E01D 19/125 285/230 |
| 5,586,834 | A * | 12/1996 | Tsuji | E01C 5/005 404/60 |
| 2003/0091384 | A1* | 5/2003 | Jo | E04B 2/7448 403/350 |
| 2003/0136071 | A1* | 7/2003 | Kobayashi | E04B 1/043 52/414 |
| 2013/0067849 | A1* | 3/2013 | Espinosa | E04B 1/4121 52/699 |
| 2013/0186030 | A1* | 7/2013 | Hebert, Jr. | E04G 15/061 52/698 |
| 2014/0013699 | A1* | 1/2014 | Gallinat | E04B 1/043 52/583.1 |
| 2014/0053475 | A1* | 2/2014 | Siqueiros | E01C 23/10 52/125.1 |
| 2016/0145854 | A1* | 5/2016 | Kawano | E04B 1/48 52/698 |
| 2016/0298329 | A1* | 10/2016 | Thompson | E04C 5/122 |

* cited by examiner

SYSTEM FOR WALL TO WALL CONNECTION FOR PRECAST SHEAR WALLS AND METHOD THEREOF

CROSS-REFERENCE TO RELATED APPLICATIONS

This United States Non-Provisional Patent Application is a National Phase Entry that relies on and claims priority to International Patent Application No. PCT/IN2017/050146, filed on Apr. 26, 2017, and Indian Patent Application No. 201621014761, filed on Apr. 28, 2016, the entire contents of both of which are incorporated herein by reference in their entireties.

FIELD OF THE INVENTION

The invention relates generally to a building construction technology, and more particularly, to a system for wall to wall connection for precast shear walls.

BACKGROUND OF THE INVENTION

Today, the most common practice to construct a shear wall is to cast it entirely on site, by using reinforcement loops of steel/wire ropes and vertical shuttering (formwork) on two sides and pouring concrete in between. This formwork needs to be supported from outsides (one or both), and needs to be poured only in maximum of 2 to 3 m heights, in order to concrete it without any quality issues like segregation due to down-pour from larger heights, etc. First, the reinforcement of the wall is tied, then the above mentioned shuttering is erected and then concrete is poured. This is repeated till the wall reached from one floor to another. For all of these operations, there is need to erect scaffolding, from one or both sides of the walls, for allowing labour and material to reach the top height of 3 m for tying steel, pouring concrete, etc. All the above mentioned processes can be summarized as follows:

i) Bringing scaffolding to the required floor
ii) Erecting scaffolding on one or both sides of the wall
iii) Shifting reinforcement from the site stack yard to the reqd. floor
iv) Tying reinforcement
v) Shifting formwork pieces to the required floor
vi) Erecting formwork
vii) Securing formwork supports
viii) Hoisting/pumping concreting to the required floor
ix) Vibrating the concrete at depths of 2-3 m
x) Curing on site at different floors
xi) Deshuttering after few days after sufficient strength is achieved in concrete (straight loss of time)
xii) And repeat the process for all floors of the building.

All the above processes are highly labour oriented and time consuming. Most of the material shifting is either done with a crane, or in most cases, with labour. Lot of supervisory staff must also be planned in order to drive the operations in the right direction, with lot of coordination with the different agencies (usually, a site has many different specialty contractors for different abovementioned activities) Specifically, transportation of all the above-mentioned material to site must be made especially, concrete, by ready mix method, frequently.

Another prior art methodology includes precast shear walls with CIS joint in between wall to wall. In this method, most of the on-site labour oriented and time-consuming works are eliminated by producing the walls horizontally (which is simpler and longer walls than 2-3 m) and can be casted in one shot. The walls are prepared on shop floor level all the time, so no need to shift material from one height to another. This also reduces loss in time and labour in material shifting, increases accuracy and quality of the concrete, etc. Since the walls are made in factory, we can introduce lot of mechanization in production of elements, as compared to site. The utility of mechanization can be continually used, for good effects, in the following stages i) Production ii) Transportation iii) Installation. More specifically, following are the stages to show the process of the precast shear walls with CIS joint:

Stage 1: Erection of the precast shear walls
Stage 2: Erect Scaffolding
Stage 3: Support the precast shear walls
Stage 4: Align and Grout the bottom of the precast shear walls
Stage 5: Breaking of concrete to expose the loop/open the wire loop box
Stage 6: Re-bending the bent loop into straight position
Stage 7: Insert Steel bars of 3/7/10 m as per design from top
Stage 8: Attach Shuttering to fill the joint (typically 200 mm wide and 250 mm deep)
Stage 9: Fill the joint with miniscule quantity of in-situ concrete.

However, after installation of walls next to each other, the mechanized process stops, because, the most reliable methodology (at least till date, before our invention) to connect the 2 walls to each other, remains a cast-in-situ joint. This is defeating (not entirely, though) the purpose of mechanizing till about say 90% of the process and ending up with doing the remaining 10% in the same primitive methodology. For a technocrat, it is all the more frustrating, as this particular 10% ends up being the critical and delaying activity whereby he has leveraged the effectiveness of Precast for the rest of the 90% of the processes.

Accordingly, there exists a need to provide system and method for wall to wall connection for precast shear walls that overcome the abovementioned drawbacks of the prior art.

OBJECTS OF THE INVENTION

An object of the present invention is to automate a process of wall to wall connection of precast shear walls.

Another object of the present invention is to provide a fast, automatic, qualitative method of the wall to wall connection with zero error guarantee and freedom from dependency on labour for multiple activities.

SUMMARY OF THE INVENTION

Accordingly, the present invention provides system for wall to wall connection for precast shear walls. The system comprises a plurality of horizontal and vertical reinforcement bars configured within the precast shear wall. Specifically, the reinforcement bars are provided with spacing there between. The system furthermore comprises a plurality of connecting tubes fixed between the spacing provided between the reinforcement bars, a plurality of openings provided between the plurality of connecting tubes, a plurality of grout tubes fixed above the plurality of openings in order to grout the openings after completing confection of the shear walls, a plurality of connecting bars capable of being inserted within the connecting tubes of the precast shear wall, when erected, a connecting device for inserting through the openings to grip the connecting bars; and a driving device to supply power to the drive for causing rotation of the drive and thereby sending the connecting bar in a translational motion from the first shear wall to the second shear wall.

In another aspect, the present invention provides a method for connecting precast shear walls. The method comprises fixing connecting tubes in the shear walls at pre-defined locations. Specifically, the connecting tubes come front to front in the shear walls, when the shear walls are placed next to each other. The method further comprises placing connecting bars in the connecting tubes of the first shear wall when the first shear wall is erected, erecting the second shear wall next the first shear wall in order to perfectly match the connecting tubes of the second shear wall to the centre-lines of the connecting tubes of the first shear wall, fitting a connecting device at opening in the first shear wall to grip the connecting bar, rotating head of the driving device thereby sending the connecting bar in a translational motion from the first shear wall to the second shear wall, and grouting the openings and gap between the walls.

DETAILED DESCRIPTION OF THE EMBODIMENTS

The foregoing objects of the present invention are accomplished and the problems and shortcomings associated with the prior art, techniques and approaches are overcome by the present invention as described below in the preferred embodiments.

The present invention provides a system and method for wall to wall connection for precast shear walls. The system and method automate the process of wall to wall connection of precast shear walls. Further, the system and method provides a fast, automatic, qualitative method of the wall to wall connection with zero error guarantee and freedom from dependency on labour for multiple activities.

The present invention is illustrated with reference to the accompanying drawings, throughout which reference numbers indicate corresponding parts in the various figures. These reference numbers are shown in bracket in the following description.

Figure 1:
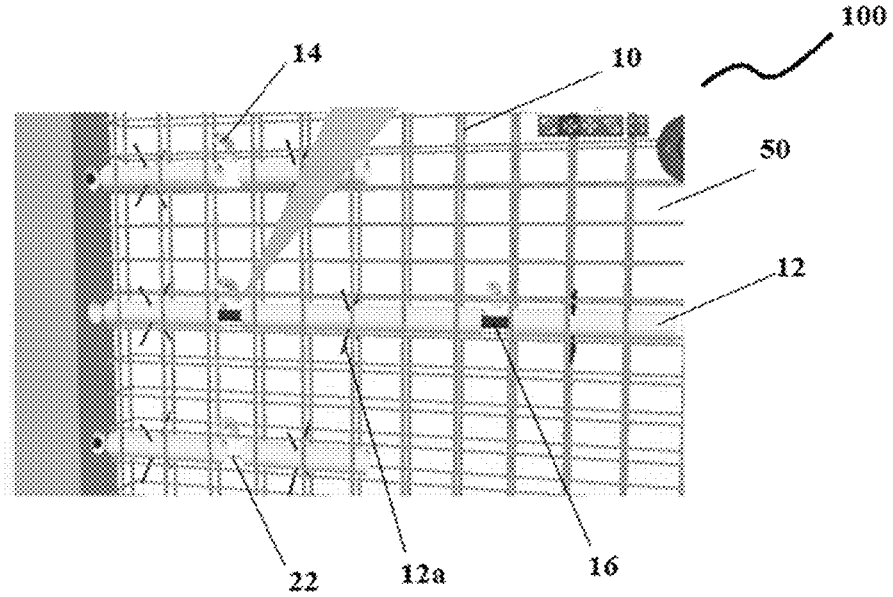
FIGS. 1 to 8 show various views of system for wall to wall connection for precast shear walls, in accordance with the present invention.
Figure 2:
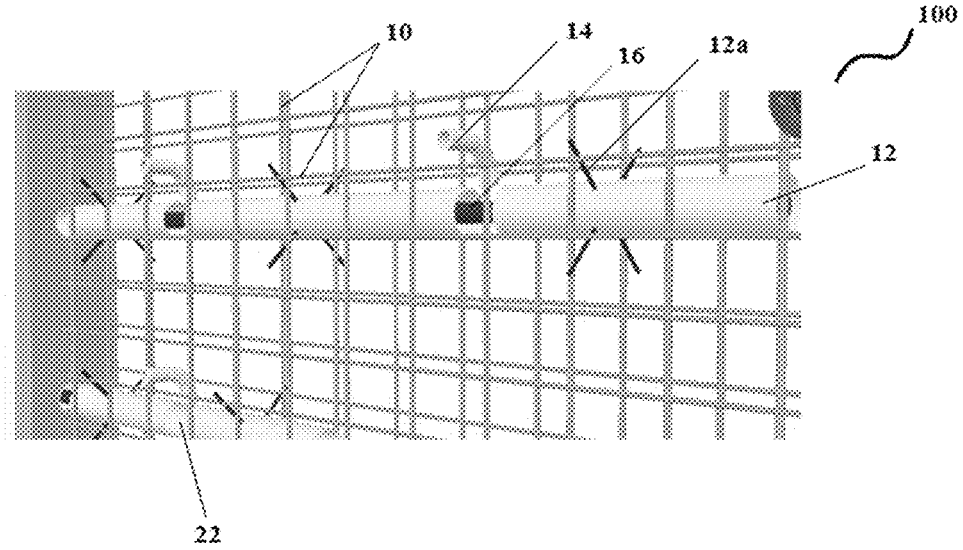
Figure 3:
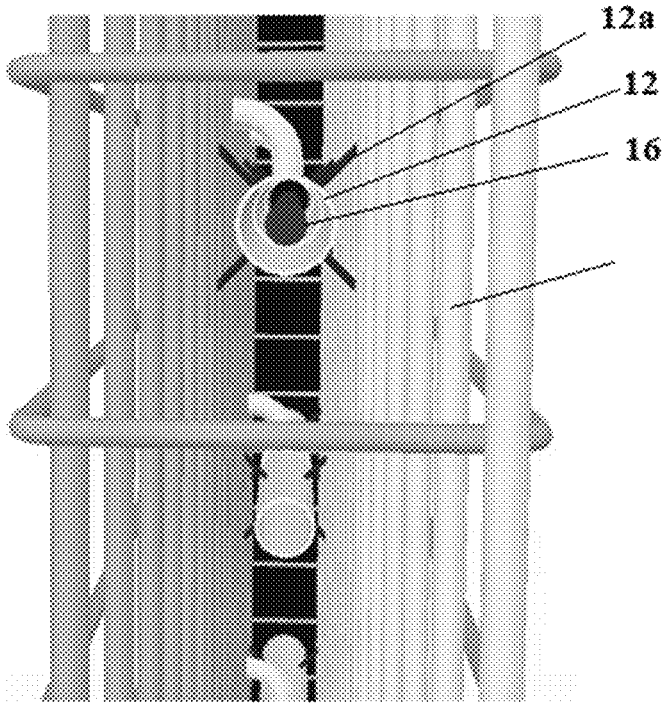
Figure 4:
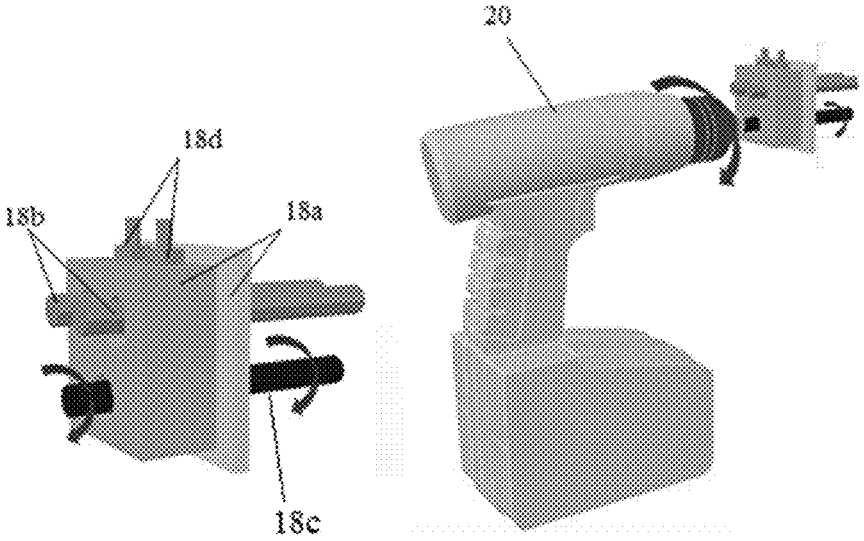
Figure 5:
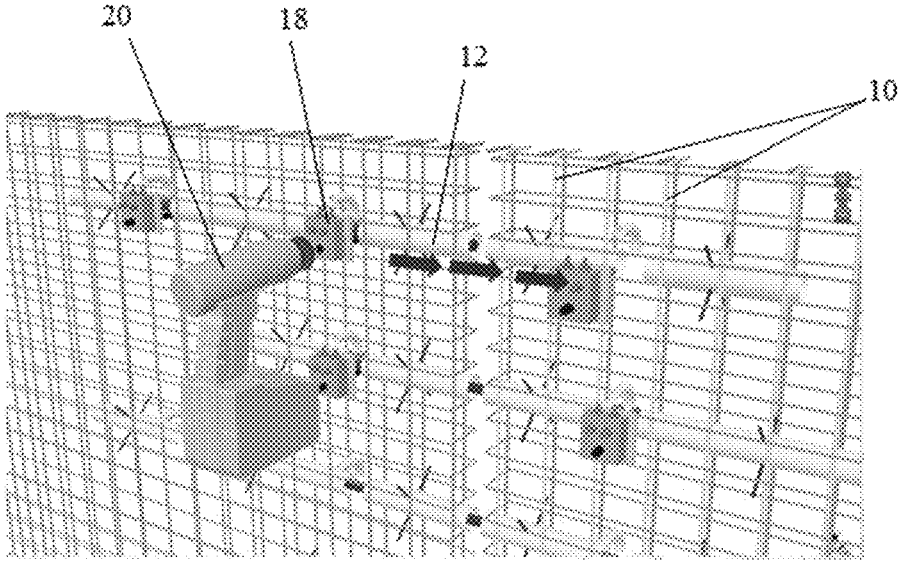
Figure 6:
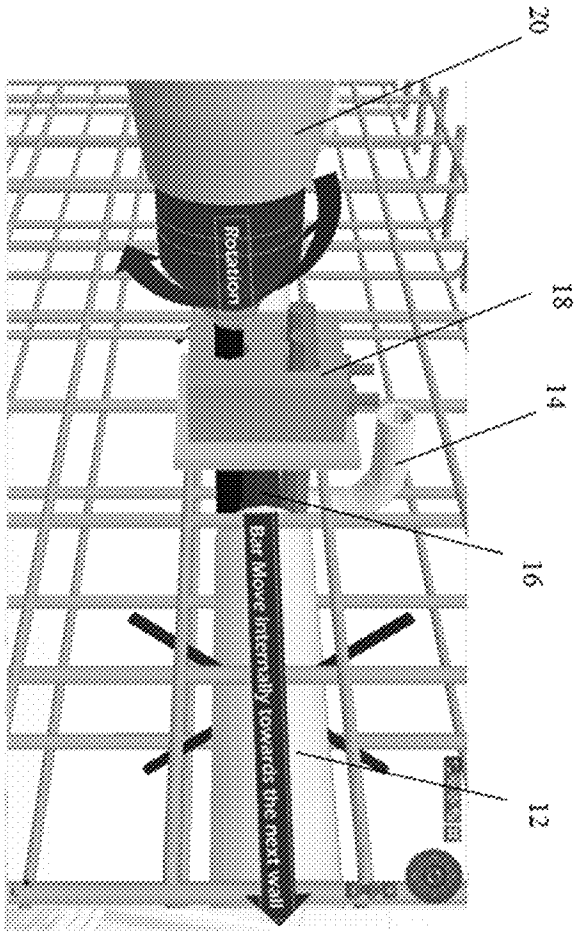
Figure 7:
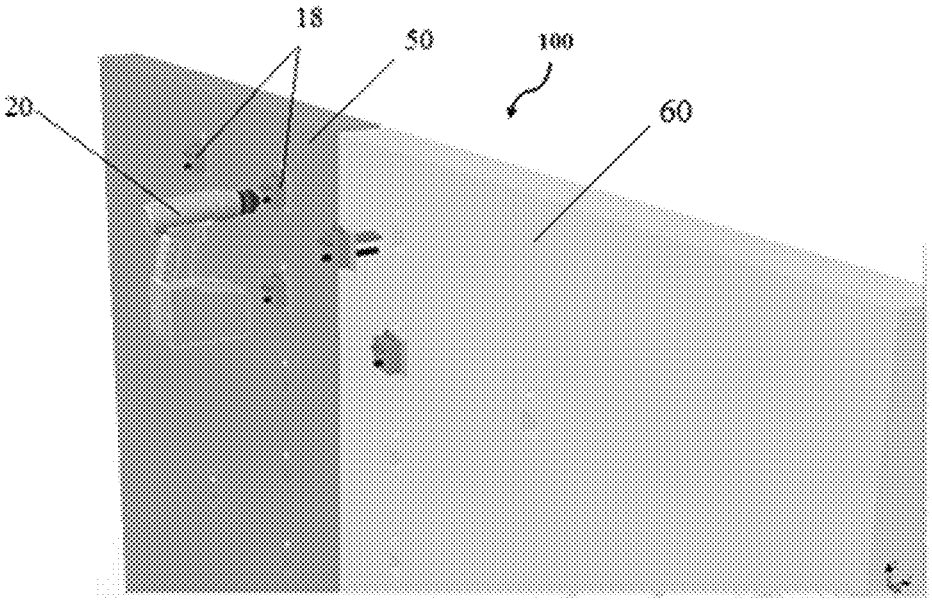
Figure 8:
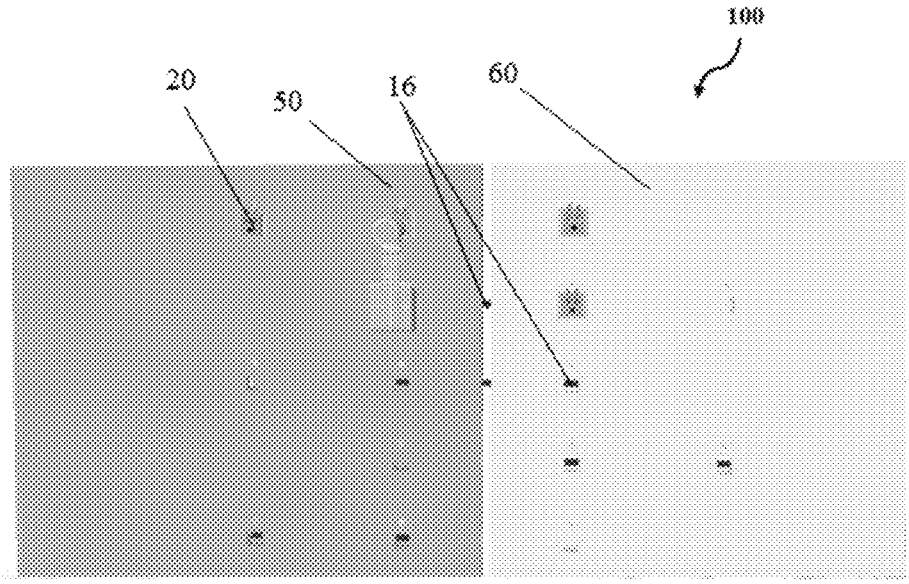

Referring to FIGS. 1 to 8, a system for wall to wall connection (hereinafter referred as, "the system (100)") for precast shear walls (50), in accordance with the present invention is shown. In an embodiment, the system (100) is used for connecting at least two precast shear walls (hereinafter referred as, "the shear walls"). The precast shear walls (50) comprises of a plurality of horizontal and vertical reinforcement bars (10) (hereinafter referred as, "the reinforcement bars (10)") provided with a spacing (not numbered) there between. In the embodiment, the reinforcement bars (10) are made of metal including steel and like, but not limited thereto.

The system (100) further comprises a plurality of connecting tubes (12) (hereinafter referred as, "the connecting tubes (12)"), a plurality of grout tubes (14) (hereinafter referred as, "the grout tubes (14)"), a plurality of connecting bars (16) (hereinafter referred as, "the connecting bars (16)"), a connecting device (18) and a driving device (20).

The connecting tubes (12) are fixed between the spacing provided between the reinforcement bars (10). The connecting tubes (12) are fixed to the reinforcement bars (10) using a plurality of holdfast (12*a*). In an embodiment, the connecting tubes (12) are fixed at pre-defined locations based on design of the shear walls. In the embodiment, length and diameter of the connecting tubes (12) and distance between the connecting tubes (12) vary based on design of the shear walls.

The system (100) comprises plurality of openings (22) (hereinafter referred as, "the openings (22)") configured between the connecting tubes (12). Specifically, the openings (22) are formed by the spacing of the reinforcement bars (10). In the embodiment, the openings (22) are provided pre-defined locations based on design of the shear walls. The grout tubes (14) are fixed above the openings (22) in order to grout the openings (22) after completing the confection of the shear walls (50).

The connecting bars (16) are inserted within the connecting tubes (12) of first shear wall (50), when the first shear wall (50) is erected. The openings (22) are used to insert the connecting device (18) therein to grip the connecting bars (16).

The detailing, location or substitution of the above embodiment can vary, by becoming more and more user friendly depending on continuous improvement process. For example, some components, like grout tube (14) can be replaced entirely, by extending the connecting tube (12) till the surface itself. In another embodiment, the number of openings 922) can be reduced and can be shaped as circular instead of orthogonal, and the like.

In an embodiment, the connecting device (18) includes at least two structural plates (18*a*), at least two idlers (18*b*), a drive (18*c*) and at least two adjustment screws (18*d*). The at least two idlers, and the drive are fixed inside the openings (22) of the at least two structural plates (18*a*). The at least two idlers (18*b*), and the drive (18*c*) are provided with a plurality of grooves (no shown) configured thereon to hold the connecting bar (16) with a better grip. The at least two adjustment screws (18*d*) are used to move the at least two idlers (18*b*) upwards and downwards in order to accommodate the connecting bar (16) between the at least two idlers (18*b*) and the drive (18*c*). The driving device (20) is used to supply power to the drive for causing rotation of the drive (18*c*) and thereby sending the connecting bar (16) in a translational motion from the first shear wall (50) to the second shear wall (60).

In an embodiment, the translational motion of the connecting bar (16) can also be simply achieved by pushing the connecting bar (16) manually from the opening (22).

Again, referring to FIGS. 1 to 8, a method for wall to wall connection for precast shear walls, in accordance with the present invention is described. The connecting tubes (12) are fixed in the shear walls (50) at pre-defined locations. The connecting tubes (12) come front to front in the shear walls, when the shear walls are placed next to each other. When the first shear wall (50) is erected, the connecting bars (16) are placed in the connecting tubes (12) of the first shear wall (50). Then, the second shear wall (60) is erected next the first shear wall (50), in order to perfectly match the connecting tubes (12) of the second shear wall to the centre-lines of the connecting tubes (12) of the first shear wall (50).

Then, the connecting device (18) is fitted at the openings in the first shear wall (50) to grip the connecting bar (16). Then, with the help of the driving device (20), a labour simply rotates a head of the driving device (20), thereby, sending the connecting bar (16) in a translational motion from the first shear wall (50) to the second shear wall (60). In an embodiment, a planned gap of 50 mm between the shear walls gets grouted, once the connecting bar (16) crosses motion from the first shear wall (50) to the second shear wall. The method is performed by using five steps including erecting the precast shear walls, providing support to the hear walls, aligning the shear walls, connecting the shear walls using the connecting device and grouting the openings and the gap between the walls.

The system (100) and the method eliminate the tiny element of in-situ concreting that was the most critical portion labour-wise, time-wise, management-wise, value-wise, agency-wise, dependency-wise.

ADVANTAGES OF THE INVENTION

1. The system and the method is fast as compared to prior art systems and methods
2. The method is less labour dependent.
3. Less quantity of steel is required.
4. Stronger connection is provided.
5. The method is simpler to achieve.
6. Minimum on-site activities are needed.
7. No CIS concrete is required.
8. The method is technology oriented.
9. The system and the method provide zero error guarantee.
10. The method is very safe as the method eliminates multiple labour oriented activities and material handling activities.
11. The method also avoids wastage of resources including water, electricity and fuels as compared to the prior art methods.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, and to thereby enable others skilled in the art to best utilize the present invention and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the claims of the present invention.

I claim:

1. A method of casting precast walls that are connectable to each other, comprising:

preparing one or more layers of a plurality of horizontal and vertical reinforcement bars;

fixing a plurality of hollow tubes to the one or more layers of the plurality of horizontal and vertical reinforcement bars at predefined locations by fasteners, the plurality of hollow tubes further being provided with openings at predetermined locations;

providing grout tubes at the openings for grouting the plurality of hollow tubes; and pouring concrete to create a precast wall.

2. The method according to claim 1, wherein the plurality of hollow tubes is fixed to the plurality of horizontal and vertical reinforcement bars using a plurality of holdfasts.

3. A precast wall made according to the method of claim 1.

4. A precast wall made according to the method of claim 2.

5. The method for connecting precast walls, the method comprising:

bringing a first precast wall and a second precast wall close to each other;

placing connecting bars in hollow tubes of the first precast wall;

erecting the second precast wall next to the first precast wall;

aligning center lines of openings of the hollow tubes in the second precast wall with openings of hollow tubes in the first precast wall;

sliding the connecting bars in a translational motion from the first precast wall into the second precast wall; and grouting the openings and a gap between the two precast walls.

6. A method for creating a wall, comprising:

preparing a first precast wall and a second precast wall by preparing at least one layer of a plurality of horizontal and vertical reinforcement bars;

fixing a plurality of hollow tubes to the at least one layer of the plurality of horizontal and vertical reinforcement bars at predetermined locations by fasteners, wherein the plurality of hollow tubes comprises openings at predetermined locations;

positioning grout tubes at the openings; and pouring concrete to create the first precast wall and the second precast wall;

moving the first precast wall to a predetermined position;

inserting connecting bars into the plurality of hollow tubes in the first precast wall;

erecting the second precast wall next to the first precast wall;

aligning center lines of the openings of the plurality of hollow tubes in the second precast wall with the openings of the plurality of hollow tubes in the first precast wall;

sliding the connecting bars, in a translational motion, from the first precast wall into the second precast wall; and grouting the openings, via the grout tubes, and any gap between the first precast wall and the second precast wall.

* * * * *